US005738444A

United States Patent [19]

Lantz et al.

[11] Patent Number: 5,738,444

[45] Date of Patent: Apr. 14, 1998

[54] COMBINATION BAG CLOSURE AND SCOOP APPARATUS

[75] Inventors: Stephen Lantz; Patricia Lantz, both of Incline Village, Nev.

[73] Assignee: Conceptual Marketing & Development, Inc., Lincoln, Calif.

[21] Appl. No.: 725,543

[22] Filed: Oct. 3, 1996

[51] Int. Cl.[6] ..... B65D 33/16

[52] U.S. Cl. ..... 383/68

[58] Field of Search ..... 383/68, 69, 70, 383/71, 82, 89

[56] References Cited

U.S. PATENT DOCUMENTS

| | | | |
|---|---|---|---|
| D. 331,023 | 11/1992 | Mulry et al. . | |
| D. 339,991 | 10/1993 | Mulry et al. . | |
| 939,520 | 11/1909 | Leyner | 383/68 |
| 1,525,333 | 2/1925 | Speirs | 383/68 X |
| 2,324,638 | 7/1943 | O'Conner | 383/68 X |
| 3,226,825 | 1/1966 | Molinaro . | |
| 4,296,529 | 10/1981 | Brown . | |
| 5,054,168 | 10/1991 | Gandy et al. . | |
| 5,347,865 | 9/1994 | Mulry et al. . | |

FOREIGN PATENT DOCUMENTS

| | | | |
|---|---|---|---|
| 2270345 | 3/1994 | United Kingdom | 383/71 |

*Primary Examiner*—Jes F. Pascua

*Attorney, Agent, or Firm*—Limbach & Limbach L.L.P.

[57] ABSTRACT

A combination bag closure and scoop is disclosed for use with flat closing bags, such as for dog kibble or coffee. The combined closure and scoop has a long, split handle attached to a cup for scooping out the contents of the bag. The split handle is used to seal the top of the bag after use by clamping around opposite sides of the bag. One side of the split handle is provided with a J-shaped portion on its distal end and the other side is provided with a flattened portion. The J-shaped and flattened portions are fastened together by slidable engagement to releasably close the bag after each use.

15 Claims, 2 Drawing Sheets

COMBINATION BAG CLOSURE AND SCOOP APPARATUS

BACKGROUND OF THE INVENTION

1. Field of the Invention

The present invention relates to bag closing devices, in particular to a bag closing device that forms a long handled scoop, such as for use with bags of dog kibble and the like.

2. Discussion of the Prior Art

Pet food or animal feed, such as dog kibble, is typically sold in tall, heavy paper bags. Once the top of the bag is opened, there are no means provided for resealing the bag other than rolling up the open end. This method of closing the bag leaves the pet food susceptible to spoilage by contact with air, moisture, rain and other contaminants. The pet food can also be fairly accessible to rodents, vermin, other animals, or the pets themselves, and is prone to being spilled.

The pet food is often dispensed from the bag with a cup or container provided by the pet owner or by dipping a pet dish into the bag. This can be unwieldy, especially when the level of the pet food nears the bottom of the bag. The pet owner typically must bend over and reach down into the tall bag, often coating his or her arm with kibble residue when contacting the inside surfaces of the bag.

What is needed, and is not provided by the prior art, is a convenient way to dispense the contents of a bag, and then easily and effectively close the bag to temporarily seal in the remaining contents for future use.

SUMMARY OF THE INVENTION

Broadly stated, the present invention, to be described in greater detail below, is directed to a bag closing device which also serves as a long-handled scoop.

In accordance with one aspect of the present invention, a bag closing device is provided with two generally parallel, elongated members rigidly connected together at one end and releasably connected together at the other end for securing a portion of a bag therebetween in a flattened manner.

In accordance with another aspect of the present invention, one of the releasably connected ends of the elongated members is provided with a generally J-shaped portion while the other elongated member is provided with a flattened end for releasable engagement with the. J-shaped portion. This simple arrangement allows for easy and reliable engagement of the two elongated members for closing the bag.

In accordance with yet another aspect of the pre, sent invention, a cup is attached to one end of the elongated members. This allows a single device to serve as both a bag closing apparatus and a scoop for scooping out the contents of the bag, with the cup being conveniently stored on the outside of the bag when the bag is closed.

In accordance with still another aspect of the present invention, the elongated members are configured as a long handle for the cup to allow a user to extend the cup down into the bag for scooping out the contents.

In accordance with still another aspect of the present invention, the entire bag closure and scoop apparatus is formed from a single piece of injection molded plastic, providing a simple, low-cost, reliable device.

In accordance with still another aspect of the present invention, an eyelet is provided on one elongated member opposite the cup for hanging up the apparatus when not in use.

DETAILED DESCRIPTION OF THE PREFERRED EMBODIMENT

Figure 1:
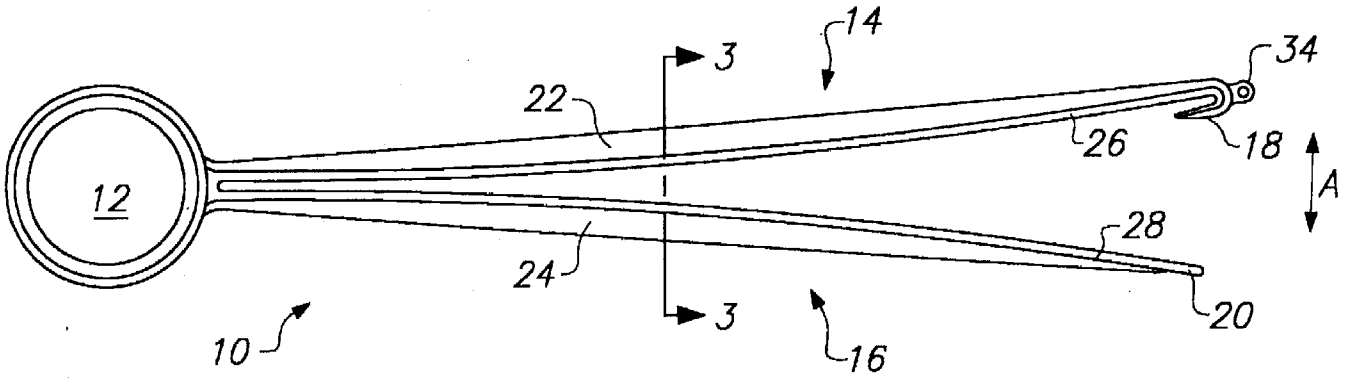
FIG. 1 is a top plan view of a combination bag closure and scoop apparatus constructed according to the preferred embodiment of the invention, showing the handle members in a disengaged position.
Figure 3:
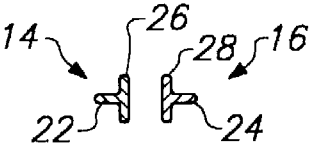
FIG. 3 is a cross-sectional view taken along line 3—3 of FIG. 1.
Figure 2:
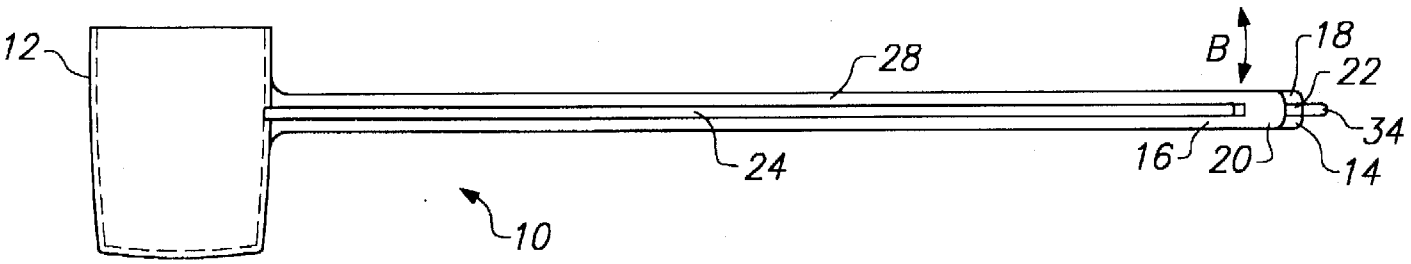
FIG. 2 is a side elevational view of FIG. 1.

Referring to FIGS. 1, 2 and 3, a combination bag closure and scoop apparatus constructed according to the invention is shown and generally referred to with the numeral 10. Scoop 10 includes a cup 12 and two elongated handle members 14 and 16 formed on one side of cup 12. One handle member 14 has a J-shaped portion 18 formed on its opposite end, while the other handle member 16 has a complementary shaped flattened portion 20.

Preferably, scoop 10 is made from a single piece of injection molded plastic. Outer ribs 22 and 24 are formed on the outside of handle members 14 and 16, respectively, to add stiffness and to provide, a more rounded contour when handle members 14 and 16 are pressed together and used as a handle. As seen in FIG. 3, handle members 14 and 16 each have a T-shaped cross-section consisting of flat, inside blades 26 and 28 and outer ribs 22 and 24, respectively.

Handle members 14 and 16 are sufficiently resilient so that they may be flexed apart horizontally, as shown by arrow A in FIG. 1, and flexed apart vertically, as shown by arrow B in FIG. 2. When handle members 14 and 16 are momentarily flexed apart vertically in the direction of arrow B, urged together horizontally in the direction of arrow A, and then returned vertically to their aligned state, flattened portion 20 slides into the recess of J-shaped portion 18 to interlock the ends of handle members 14 and 16. Preferably there is a slight interference fit between J-shaped portion 18 and flattened portion 20 so that they remain interlocked until purposefully disengaged. In this interlocked position, handle members 14 and 16 are parallel to each other with both ends attached together. A slight gap between blades 26 and 28 exists for most of the length of handle members 14 and 16. With handle members 14 and 16 interlocked (or at least pressed together), a long handle is formed on cup 12 such that the bottom of a typical kibble bag is easily reachable with scoop 10.

Figure 4:
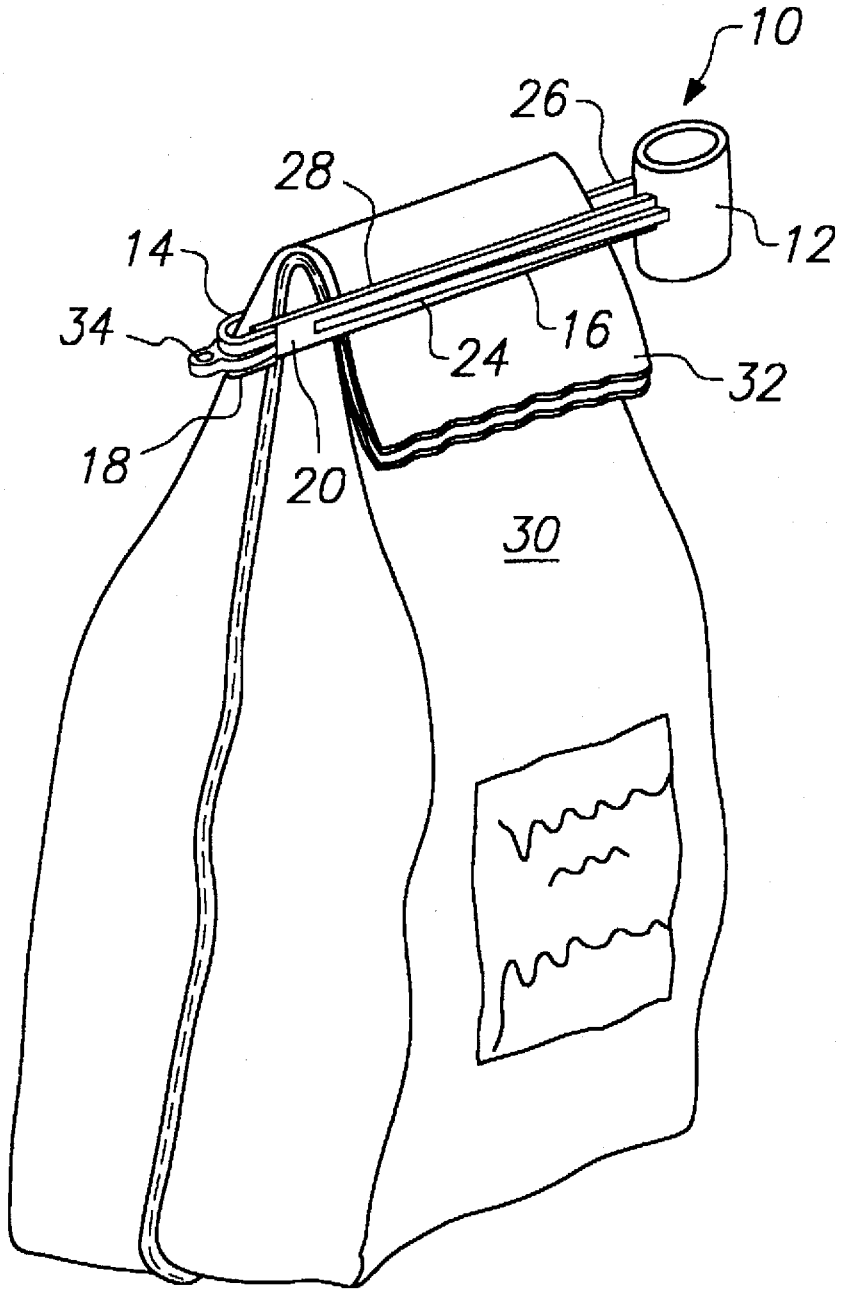
FIG. 4 is a perspective view showing the preferred embodiment of the inventive apparatus clamped around a bag.

Referring to FIG. 4, scoop 10 is shown clamped around the top of bag 30. The top 32 of bag 30 may be folded over as shown, or left in an upright position. To attach scoop 10 to bag 30 in order to close it, handle members 14 and 16 are separated as described above and slid over bag 30 with handle members 14 and 16 on opposite sides of bag 30. Flattened portion 20 is then interlocked with J-shaped portion 18 as described above. In this position, bag 30 is sandwiched between the inside surfaces of blades 26 and 28 and is sealed shut. Because handle members 14 and 16 are resiliently flexible and flattened portion 20 can slide horizontally with respect to J-shaped portion 18, varying thicknesses of bags can be accommodated. To re-open bag 30, flattened portion 20 is slid vertically out of J-shaped portion 18 and scoop 10 is removed from bag 30.

Eyelet 34 is provided on the outside of J-shaped portion 18 to hang up scoop 10 when not being used for scooping or closing a bag.

In the preferred embodiment, scoop 10 has a handle length of about 19 inches. Cup 12 has a maximum outer diameter of about 3.6 inches, a height of 4.2 inches, and an inside volume of 2 cups (i.e. one pint). Blades 26 and 28 are 0.75 inches tall and have a nominal thickness of 0.150. Ribs 22 and 24 protrude a maximum of 0.50 from the center of blades 26 and 26, taper to a width of 0.90 near the ends, and have a nominal thickness of 0.150.

The present invention can be manufactured to work with a variety of bag sizes. For example, a much smaller version can be used to scoop and close a small bag of ground or whole coffee beans. The bag closure portion of the invention may also be made and used without cup 12 attached.

The above descriptions and drawings are for illustrative purposes only, and are not exhaustive of possible alternate embodiments of the invention. It is to be understood that the present invention is not limited to the sole embodiment described above and illustrated herein, but encompasses any and all variations falling within the scope of the appended claims and their equivalents.

What is claimed as the invention is:

1. A combination bag closure and scoop apparatus comprising:

a cup;

an elongated handle member attached to the cup and generally extending radially outward therefrom; and an elongated clamp member having a first end rigidly attached to the elongated handle member and a second end releasably attachable to the handle member such that when the second end is attached to the handle member the clamp member extends substantially parallel to the handle member for releasably securing a flattened portion of a bag therebetween.

2. A combination bag closure and scoop apparatus according to claim 1 wherein the handle and clamp members each have a proximal and a distal end, both proximal ends being rigidly attached to each other and to the cup, the handle and clamp members being substantially identical except for their distal ends, the distal end of the handle member having a hook for releasably securing the distal end of the clamp member.

3. A combination bag closure and scoop apparatus according to claim 1 wherein the handle and the clamp members have opposing generally flat inside surfaces for contacting the bag and generally rounded outside portions for gripping when the members are used as a cup handle.

4. A combination bag closure and scoop apparatus according to claim 1 wherein the entire apparatus is formed from a single piece of injection molded plastic.

5. A combination bag closure and scoop apparatus according to claim 1 wherein each of the handle members has a length of at least fifteen inches.

6. A combination bag closure and scoop apparatus according to claim 1 wherein the cup has a volume of at least one-half pint.

7. A combination bag closure and scoop apparatus comprising:

a cup;

a first elongated handle member having a proximal end and a generally J-shaped distal end, the proximal end being rigidly connected to the cup, the first handle member generally extending radially outward from the cup; and a second elongated handle member having a proximal end rigidly connected to the cup and to the proximal end of the first member, the second member having a flattened distal end for slidable engagement with the generally J-shaped distal end of the first member to releasably connect the distal ends of the two members, wherein the two handle members can be held in one hand by a user to extend the reach of the cup down into a bag, and wherein the two members are resiliently flexible such that the two distal ends can be momentarily flexed apart in a horizontal direction to receive a flattened portion of the bag therebetween, and such that the two distal ends can be momentarily flexed apart in a vertical direction allowing the complementary shaped distal end to be slidably engaged with the generally J-shaped distal end for releasable connection therewith, thereby enclosing the portion of the bag and clamping the portion shut in a substantially flat manner.

8. A combination bag closure and scoop apparatus according to claim 7 wherein the entire apparatus is formed from a single piece of injection molded plastic.

9. A combination bag closure and scoop apparatus according to claim 7 wherein the first and second handle members each have a T-shaped cross-section formed by a generally flat inside wall and a rib protruding perpendicularly outward from a mid-section of the inside wall.

10. A combination bag closure and scoop apparatus according to claim 7 further comprising an eyelet protruding from the distal end of one of the handle members for hanging the apparatus when not in use.

11. A combination bag closure and scoop apparatus according to claim 7 wherein each of the handle members has a length of at least fifteen inches.

12. A combination bag closure and scoop apparatus according to claim 7 wherein the cup has a volume of at least one-half pint.

13. A bag closure apparatus comprising;

a first elongated member having a proximal end and a generally J-shaped distal end;

a second elongated member having a proximal end rigidly joined to the proximal end of the first member, and a complementary shaped distal end for slidable engagement with the generally J-shaped end of the first member, and a cup attached to at least one of the elongated members for receiving therein a part of the contents of a bag, wherein at least one of the two members is resiliently flexible such that the two distal ends can be momentarily flexed apart in a horizontal direction to receive a flattened portion of the bag therebetween, and such that the two distal ends can be momentarily flexed apart in a vertical direction allowing the complementary shaped distal end to be slidably engaged with the generally J-shaped distal end, thereby enclosing the portion of the bag and clamping the portion shut in a substantially flat manner.

14. A bag closure apparatus according to claim 13 wherein the cup is rigidly attached to one end of at least one of the elongated members such that the member can be used as an elongated handle for extending the reach of the cup.

15. A method of releasably closing a flattened top portion of a bag having two sides and later re-opening the bag and scooping out a portion of its contents, the method comprising the steps of:

providing two generally parallel elongated members rigidly attached together at a proximal end;

sliding the two members over the top portion of the bag, one member on each side of the bag;

flexing the members apart in a vertical direction;

urging the members together in a horizontal direction to sandwich the bag therebetween;

unflexing the members back together in the vertical direction until a feature on a distal end of one of the members releasably interlocks with a complementary shaped feature on the other of the two members thereby securing the bag in a closed position to seal in the contents of the bag for later use, re-opening the bag at a later time by flexing the members apart in a vertical direction to release the two interlocking features on the distal ends thereof and sliding the members off of the bag, and scooping out a portion of the contents of the bag by grasping at least one of the elongated members and inserting one of its ends into the bag, the one end having a cup or scoop rigidly attached thereto.

* * * * *